US006901703B2

(12) United States Patent
Langenbach

(10) Patent No.: US 6,901,703 B2
(45) Date of Patent: Jun. 7, 2005

(54) CRASH PROTECTION DEVICE

(75) Inventor: Guido Langenbach, Buchholz (DE)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

(21) Appl. No.: 10/109,101

(22) Filed: Mar. 25, 2002

(65) Prior Publication Data

US 2003/0046870 A1 Mar. 13, 2003

Related U.S. Application Data

(63) Continuation of application No. PCT/EP00/03363, filed on Apr. 14, 2000.

(51) Int. Cl.[7] ..... E05D 15/38
(52) U.S. Cl. ..... 49/197; 49/199; 160/205
(58) Field of Search ..... 49/141, 425, 197, 49/199; 160/205, 274, 271, 273.1, 267.1, 281

(56) References Cited

U.S. PATENT DOCUMENTS

| | | | |
|---|---|---|---|
| 778,228 | A | 12/1904 | Dodge et al. |
| 1,033,224 | A | 7/1912 | Andlauer |
| 1,550,237 | A | 8/1925 | Beckman |
| 1,972,182 | A | 9/1934 | Chamberlain, Jr. et al. |
| 2,134,397 | A | 10/1938 | Clark |
| 2,406,272 | A | 8/1946 | Voorhees |
| 2,641,031 | A | 6/1953 | Ehret |
| 2,786,523 | A | 3/1957 | Phillips |
| 2,839,135 | A | 6/1958 | Anderson |
| 2,845,117 | A | 7/1958 | Barry |

(Continued)

FOREIGN PATENT DOCUMENTS

| | | |
|---|---|---|
| DE | 32 45 009 A1 | 6/1984 |
| DE | 295 01 048.7 | 3/1995 |
| DE | 197 26 156 A | 12/1998 |
| EP | 0 125 217 | 11/1984 |
| EP | 0 129 925 A | 1/1985 |
| EP | 0 397 619 A | 11/1990 |
| FR | 1 009 862 | 6/1952 |
| GB | 240349 | 10/1925 |
| GB | 503774 | 4/1939 |
| GB | 1 444 017 | 7/1976 |
| GB | 2 093 895 | 9/1982 |
| WO | WO 95/19486 | 7/1995 |
| WO | WO 00/63518 | 10/2000 |

OTHER PUBLICATIONS

"*Super Seal Series 6500 Breakaway Panel Competitive Analysis*" Apr. 1996, SuperSeal Mfg. Ltd.
"*Atmodoor Environmental Control Doors*" Apr. 1995, SuperSeal Mgf. Ltd.
"*EnviroDor SRS Section Release System*" EnvirDor, Inc.
International Search Report from PCT/EP00/03363.
"*Re–Coil–Away" Specifications* Brochure, 2 pages.

(Continued)

*Primary Examiner*—Jerry Redman
(74) *Attorney, Agent, or Firm*—Hanley, Flight & Zimmerman, LLC

(57) ABSTRACT

Doors and breakaway mechanisms for use with a door are disclosed. A disclosed door includes a panel; a guide located adjacent a doorway opening; a carriage; and a coupling releasably securing the carriage to the panel. The coupling releases the panel from the carriage in response to a breakaway force. The magnitude of the breakaway force is dependent on a condition such as the position of the door relative to the doorway or the position of a roller carried by the carriage.

10 Claims, 3 Drawing Sheets

U.S. PATENT DOCUMENTS 3,149,665 A 9/1964 Handford
3,336,968 A 8/1967 Curtis
3,484,812 A 12/1969 Holland
3,878,879 A 4/1975 Manns
4,016,920 A 4/1977 Shepard
4,241,540 A 12/1980 Depperman
4,269,253 A 5/1981 Ziegler
4,452,292 A 6/1984 Leivenzon et al.
4,478,268 A 10/1984 Palmer
4,569,383 A 2/1986 Wentzel
4,572,268 A 2/1986 Wentzel
4,601,320 A 7/1986 Taylor
4,649,981 A 3/1987 Bibeau
4,676,293 A 6/1987 Hanssen
4,690,195 A 9/1987 Taylor
4,726,148 A 2/1988 Tix
4,800,946 A 1/1989 Rosenoy
4,884,617 A 12/1989 Coenraets
4,887,660 A 12/1989 Kraus
4,896,714 A 1/1990 Ellis
4,934,437 A 6/1990 Kraeutler
5,025,847 A 6/1991 Mueller
5,048,588 A 9/1991 Weishar et al.
5,056,579 A 10/1991 Krafutler
5,058,651 A 10/1991 Ashley et al.
5,078,197 A 1/1992 Weishar
5,123,474 A 6/1992 Smith
5,129,442 A 7/1992 Warner
5,139,074 A 8/1992 Warner
5,139,075 A 8/1992 Desrochers
5,141,043 A 8/1992 Kraeutler
5,141,044 A 8/1992 Hying et al.
5,207,256 A 5/1993 Kraeutler
5,219,015 A 6/1993 Kraeutler
5,222,541 A 6/1993 Hornberger
5,271,448 A 12/1993 Delgado
5,299,617 A 4/1994 Hying et al.
5,353,859 A 10/1994 Oltahfer et al.
5,368,084 A * 11/1994 Hying et al. ..... 160/265
5,392,836 A 2/1995 West et al.
5,477,902 A 12/1995 Kraeutler
5,526,865 A 6/1996 Coenraets
5,535,805 A 7/1996 Kellogg et al.
5,562,141 A 10/1996 Mullet et al.
5,579,820 A 12/1996 LePage et al.
5,584,333 A 12/1996 Torchetti et al.
5,601,133 A 2/1997 Krupke et al.
5,620,039 A 4/1997 Delgado et al.
5,632,317 A 5/1997 Krupke et al.
5,638,883 A 6/1997 Schulte
5,655,591 A 8/1997 Knutson
5,720,332 A 2/1998 Nachreiner
5,727,614 A 3/1998 Lichy
5,743,317 A * 4/1998 Beringer et al. ..... 160/10
5,765,622 A * 6/1998 Lichy ..... 160/273.1
5,829,504 A 11/1998 Ekstrand et al.
5,865,235 A 2/1999 Krupke et al.
5,887,385 A * 3/1999 Horner et al. ..... 49/26
5,893,403 A 4/1999 Megens
5,915,448 A 6/1999 Schulte
5,918,660 A 7/1999 Crawford, III et al.
5,927,368 A 7/1999 Rohrer et al.
5,944,086 A 8/1999 Gruben et al.
5,957,187 A * 9/1999 Gruben et al. ..... 160/267.1
6,019,156 A 2/2000 Wagner et al.
6,039,106 A 3/2000 Gontarski et al.
6,041,844 A 3/2000 Kellogg et al.
6,053,237 A 4/2000 Bertilsson et al.
6,089,305 A 7/2000 Gruben et al.
6,095,229 A 8/2000 Kellogg et al.
6,119,307 A 9/2000 Weishar et al.
6,123,139 A 9/2000 Kalempa et al.
6,148,897 A 11/2000 Horner et al.
6,315,027 B1 11/2001 Lichy
6,439,292 B1 8/2002 Schütte et al.
6,615,898 B2 9/2003 Schulte

OTHER PUBLICATIONS

"*Re–Coil–Away*" Installation Instructions, M & I Door Systems Limited, Barrie, Ontario, Canada, 18 pages, Revised May, 1991.
"*The Near Indestructible, Maintenance–Free Rubber Door Systems*" Brochure, M & I Door Systems Limited, Barrie, Ontario, Canada, 2 pages.
"*Fastdoor*" Brochure, M & I Door Systems Limited, Barrie, Ontario, Canada, 2 pages.
"*Rytec Breaks Away!*" Brochure, Rytec HIgh Performance Doors, Jackson, Wisconsin, 2 pages.
"*Rapid Roll ®Doors: The Super–Fast Solution!*" Brochure, Rapid Roll® Doors, 8 pages, (1990).
"*SPIRIT High Speed Roll–Up Door*" Brochure, Marathon Door Division, ASI Technologies, Inc., Milwaukee, Wisconsin, 3 pages.
"*RT Series Patented Tufflex Beam™And Releasable Optioni*" Brochure, Kelley Company, Inc., Milwaukee, Wisconsin, 2 pages, (1993).
"*KELLEY Door Selection Guide*", Kelley Company, Inc., Milwaukee, Wisconsin, 16 pages.
"*Commercial Plastics—A Case History*" Brochure, 1 page.
"*JETROLL™Ultra High Speed Traffic Door*" Brochure, Oct 1995, Copyright 1995 Overhead Door Corporation.
"*TKO™The Knock Out Dock Door*" Brochure, HPD International, Inc.
"*JETSET™Breakaway Bottom Bar for the JETROLL Door*" Oct. 1995; Copyright 1995 Overhead Door Corporation.

* cited by examiner

FIG.1
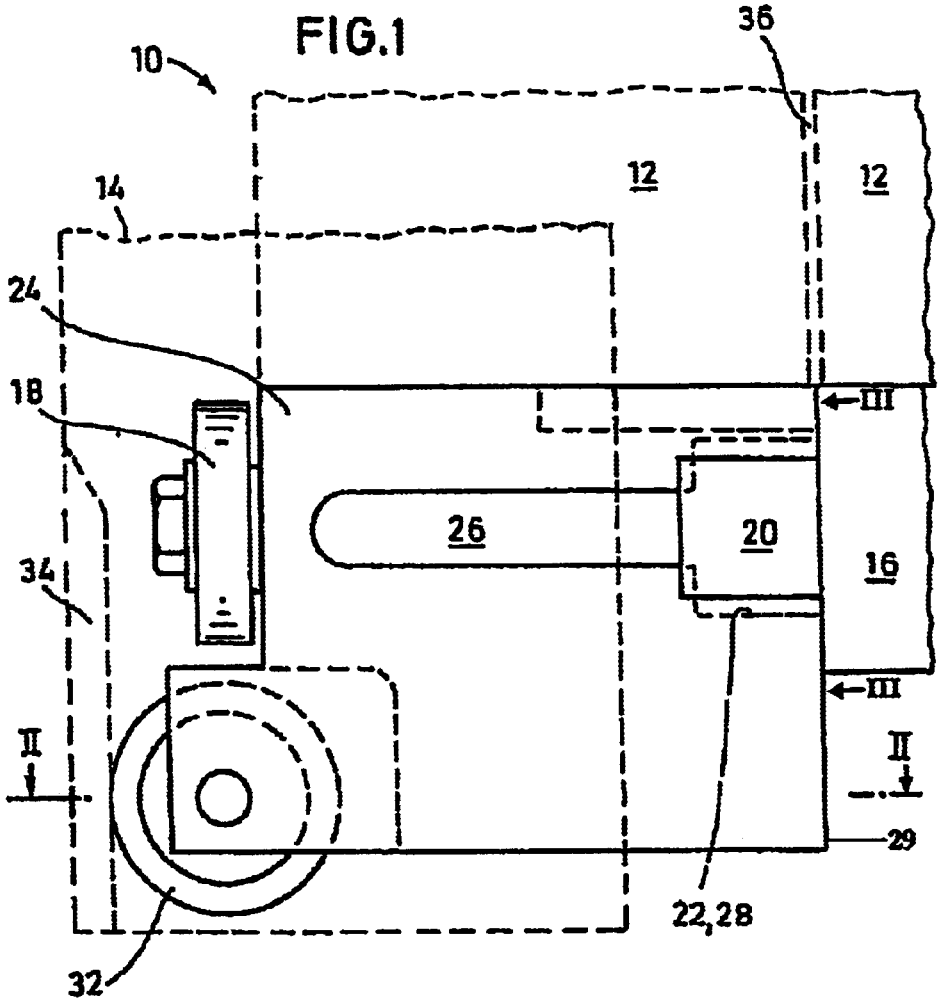
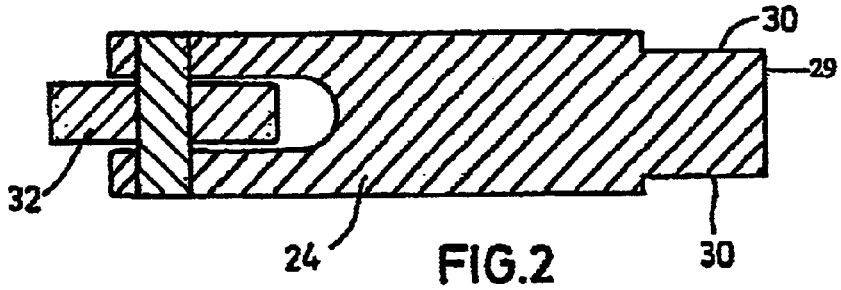
FIG.2

CRASH PROTECTION DEVICE

RELATED APPLICATION

This patent arises from a continuing application which claims priority under 35 U.S.C. § 120 from International Patent Application No. PCT/EP00/03363, filed Apr. 14, 2000.

FIELD OF THE INVENTION

The invention relates generally to doors, and more particularly, to a crash protection device for high-speed roller doors/gates with a high-speed roller door/gate panel or with several gate elements (e.g., door panels) arranged vertically one above the other.

BACKGROUND OF THE INVENTION

A crash protection device which reliably disengages a door or gate panel or gate elements in the event of an unintended collision of the high-speed roller door panel or gate elements with a person or vehicle is known from DE 197 26 156 A1. The high-speed roller door or gate panel or the gate elements can be re-engaged by raising the high-speed roller door panel or gate elements.

It has been found, however, that, in strong winds or during storms, the high-speed roller door panel or gate elements can become disengaged even though no collision has occurred.

BRIEF DESCRIPTION OF THE DRAWINGS

FIG. 1 shows a side area of the bottom of a high-speed roller door with a bottom bar or brace, a coupling, a guide rail, and a panel.

FIG. 2 shows a cross section through the high-speed roller gate along line II—II of FIG. 1.

DESCRIPTION OF THE PREFERRED EXAMPLES

Figure 3:
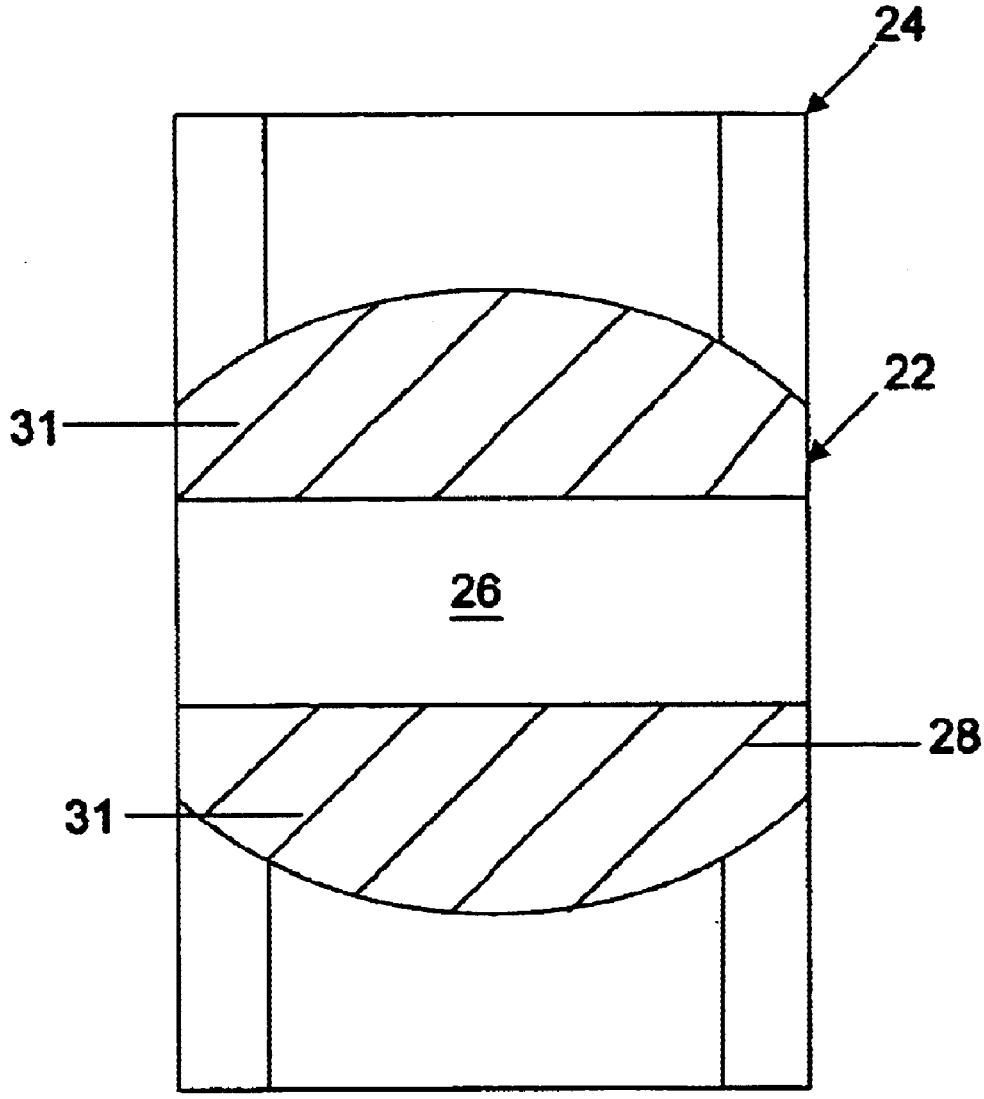
FIG. 3 is an end view taken along lines 111—111 of FIG. 1.

The high-speed roller door or gate 10 shown in FIG. 1 has a high-speed roller door or gate panel 12, which moves in the vertical direction. As used herein, the term "panel" includes a flexible member (e.g., a curtain in a roller-type door) and/or a rigid member (e.g., a section of a sectional door). The high-speed roller door panel 12 is guided at the side in a U-shaped guide rail 14 and has reinforcing profiles (not shown) at intervals of about 50cm, extending crosswise to the direction in which the panel moves. The panel 12 also has one or more bottom members, illustratively in the form of bars or braces 16 at its lower end. The bottom bar(s)/brace(s) are connected to a guide roller 18 via a coupling described below. The guide roller 18 travels along the guide rail 14.

So that the high-speed roller door panel 12 can swing out freely when a collision occurs, the bottom brace 16 is provided at both ends with rounded plastic pins 20 of polyamide, preferably in the form of round cylinders. Each of the pins 20 forms the first connector element of a coupling. When in the operating position, each plastic pin 20 is held in a respective receiving space 22, which is open at one end.

The receiving space 22 is formed in a plastic block or carriage 24 of polyamide, which serves as the second connector element of the coupling. Persons of ordinary skill in the art will appreciate that a plastic block 24 and a corresponding pin 20 is provided at each bottom corner of the door. These blocks 24 and pins 20 are identical in function and structure, but oriented in opposite directions. Because of these similarities, in the interest of brevity, the remainder of this description will focus on one block 24, one pin 20, and one coupling therebetween. It will be understood, however, that the description is equally applicable to either block 24, either pin 20, and either coupling.

The receiving space 22 is formed in the block 24 by milling out a slot 26 and then by drilling a hole or cup 28 proceeding inward from the end surface 29 of the block. The part of the block 24 above the slot 26 is able to resiliently flex upwardly slightly relative to the part of the block 24 below the slot 26 (and/or vice versa). Thus, the slot 26 divides the block 24 into a pair of gripper arms. As shown in FIG. 3, the hole or milled-out area 28 has a diameter which is greater than the thickness of the material of the plastic block 24. As a result, the receiving space 22 is open at the sides but is still able to hold the plastic pin 20 and to keep it firmly in place through a friction fit and through the holding force of the gripper arms.

The plastic block 24 is reduced in thickness at its end to form a profiling 30 as shown in FIG. 2. This profiling 30 has the effect that the plastic pin 20 is surrounded to varying degrees depending on the depth to which it is inserted into the receiving space 22. To increase the retaining force when the plastic pin 20 is fully received in the space 22 such that the end surface of the pin 20 engages a back surface 31 of the space 22, the plastic pin 20 can have a friction coating on its end surface.

The depth to which the plastic pin 20 is inserted into the space 22 is controlled by a roller 32 and a camming surface or ramp 34. In particular, as shown in FIG. 1, the roller 32 rides along a back surface of the guide 14 during vertical travel of the door. The camming surface or ramp 34 is mounted at the bottom of the guide 14. When the door approaches its lowermost position, the roller 32 is cammed inward from the back surface of the guide 14 and travels along the ramp 34. When the roller travels along the ramp 34, the plastic block 24 is pushed inward toward the bottom bar/brace 16, so that the plastic pin 20 becomes more deeply inserted into the space 22.

Figure 4:
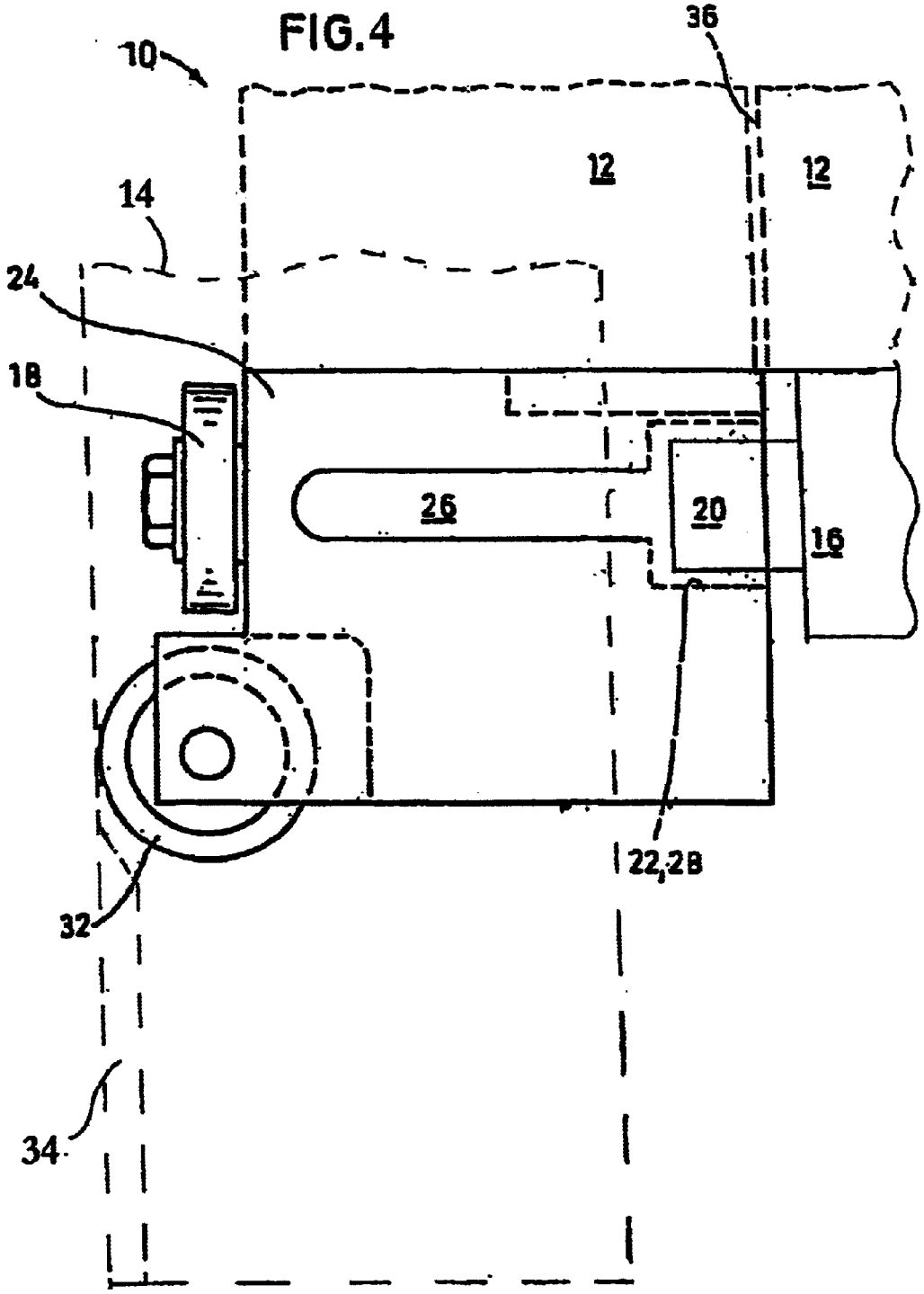
FIG. 4 illustrates the structure of FIG. 1 but shows a side area of the bottom of a roller disengaged from a cam surface.

When the high-speed roller door panel 12 is raised, the flexibility of the material of tbe high-speed roller door panel 12 has the effect that, despite the slit 36 which allows the panel to swing out (shown in exaggerated fashion in FIG. 1), the connector elements are able to move away from each other. Thus the enhanced coupling of the pin 20 and space 22 is disengaged, and the panel 12 can swing out in the event of a collision. FIG. 4 illustrates the apparatus of FIG. 1 under a condition in which the roller 32 been raised above the ramp 34. such that plastic block 24 has moved outward away from the bottom bar/brace 16. 50 that the plastic pin 20 becomes less deenlv inserted into the space 22. The retaining force of the coupling can be controlled by the depth of the slot 26, by the choice of material of the block 24 and/or the pin 20, and by the ratio of the diameter of the pin 20 to the thickness of the plastic block 24.

To assist the disengaging movement and for use with gate elements, a compression spring can be provided in the slot 26.

The disclosed devices make available a crash protection device for a high-speed roller door which is able to withstand strong winds and storms.

As discussed above, the coupling automatically enters into an enhanced retention mode when the high-speed roller door panel 12 is in the lowermost position. In other words, the breakaway mechanism of the disclosed device is structured to release the door panel 12 when an external force above a first threshold is applied when the door is in an open or partially open position, and to release the door panel 12 only when an external force above a second threshold higher than the first threshold is applied when the door is in a closed or substantially closed position. As a result, without any effect on the ability of the coupling to become disengaged while the door is in operation or in the open or partially open positions, it is nevertheless ensured that the closed or substantially closed door cannot be opened unintentionally or without being noticed in a storm or in a strong wind. Because the locking device enters the enhanced retention mode automatically when the door is in the lowermost position, there is no longer any chance that ignorance of the impending arrival of such an event or forgetfulness could lead to a failure to secure the gate against a storm or strong winds.

The illustrated crash protection device also offers the advantage of increased security against break-ins, because it provides enhanced resistance to attempts to intentionally disengage the breakaway mechanism of the door by the application of force when the door is in the lowermost (i.e., closed) position.

It is preferable for the locking to be accomplished by the application of a force acting in the longitudinal direction of the bottom bar. A reliable design solution is obtained by providing a guide element in the form of a roller, which travels along a ramp to actuate the enhanced retention feature.

Although certain apparatus constructed in accordance with the teachings of the invention have been described herein, the scope of coverage of this patent is not limed thereto. On the contrary, this patent covers all embodiments of the teachings of the invention fairly falling within the scope of the appended claims either literally or under the doctrine of equivalents.

What is claimed is:

1. For use with a doorway including a guide track, and a door mounted for movement along the guide track and including a panel, a breakaway mechanism comprising:

a carriage defining an aperture;

a roller mounted to the carriage and positioned to operatively engage the guide track;

a projection dimensioned to engage the aperture to create a force releasably securing the projection in the aperture, wherein the force has a magnitude which is dependent upon a penetration depth of the projection relative to the aperture; and a camming surface positioned to displace the roller to cause relative movement between the projection and the aperture to change the magnitude of the force.

2. A breakaway mechanism as defined in claim 1 wherein the carriage has a first end and a second end, the roller is journaled in the first end and the aperture is defined in the second end.

3. A breakaway mechanism as defined in claim 2 wherein the first end of the carriage has a first thickness and the second end of the carriage has a second thickness below the first thickness.

4. A breakaway mechanism as defined in claim 3 wherein the aperture is semi-circular and has a diameter greater than the second thickness.

5. A breakaway mechanism as defined in claim 4 wherein the carriage defines a slot and the slot is in communication with the aperture.

6. A breakaway mechanism as defined in claim 1 wherein a back surface of the aperture frictionally engages the projection when the projection is fully inserted into the aperture.

7. A breakaway mechanism as defined in claim 1 wherein the projection comprises a cylindrical pin.

8. A breakaway mechanism as defined in claim 1 wherein the second end with the second thickness has a first length, and the aperture penetrates the carriage beyond the first length.

9. A door for use with a doorway opening comprising:

a panel;

a guide located adjacent the doorway opening; and a carriage releasably secured to the panel, wherein the carriage has a first release threshold such that the carriage releases from the panel when the panel is subjected to a force having a first value and the door is not closed, and the carriage has a second release threshold such that the carriage releases from the panel when the panel is subjected to a force having a second value and the door is in a closed position, and wherein the force of the second value is greater than the force of the first value and the second release threshold is greater than the first release threshold.

10. A door for use with a doorway opening comprising:

a panel;

a guide located adjacent the doorway opening; and a carriage releasably secured to the panel, wherein the carriage has a first release threshold such chat the carriage releases from the panel when the carriage is subjected to a release force above the first release threshold and the door is not closed, and the carriage has a second release threshold such that the carriage releases from the panel when the carriage is subjected to a release force above the second release threshold and the door is in a closed position, the second release threshold being greater than the first release threshold.

* * * * *